US006714111B2

(12) United States Patent
Suzuki

(10) Patent No.: US 6,714,111 B2
(45) Date of Patent: Mar. 30, 2004

(54) INVERTER TRANSFORMER

(75) Inventor: Shinichi Suzuki, Iwata-gun (JP)

(73) Assignee: Minebea Co., Ltd., Nagano (JP)

( * ) Notice: Subject to any disclaimer, the term of this patent is extended or adjusted under 35 U.S.C. 154(b) by 0 days.

(21) Appl. No.: 10/146,887

(22) Filed: May 17, 2002

(65) Prior Publication Data

US 2002/0176268 A1 Nov. 28, 2002

(30) Foreign Application Priority Data

May 25, 2001 (JP) ..... 2001-157062

(51) Int. Cl.[7] ..... H01F 21/00; G05F 1/325
(52) U.S. Cl. ..... 336/110; 323/250
(58) Field of Search ..... 363/97, 153; 336/110, 336/183, 185, 186, 174, 173, 175, 219, 221; 323/251, 250, 230, 332, 355

(56) References Cited

U.S. PATENT DOCUMENTS 5,359,313 A * 10/1994 Watanabe et al. ..... 336/178
5,598,135 A * 1/1997 Maeda et al. ..... 336/200
5,852,866 A * 12/1998 Kuettner et al. ..... 29/608
5,884,990 A * 3/1999 Burghartz et al. ..... 336/200
6,201,463 B1 * 3/2001 Yamashita et al. ..... 336/198

* cited by examiner

*Primary Examiner*—Rajnikant B. Patel
(74) *Attorney, Agent, or Firm*—Oliff & Berridge, PLC

(57) ABSTRACT

An inverter transformer is provided which can turn on a plurality of cold cathode fluorescent lamps (CFLs) with a minimized increase in the number of components, thereby reducing costs. The inverter transformer comprises a plurality of bobbins for windings. The plurality of bobbins each having a secondary winding wound thereon and having a bar-shaped inner core inserted therein are connected to one another for integration, and a primary winding is wound in common on the bobbins connected together. A plurality of inner cores and a rectangular frame-shaped outer core are magnetically coupled with each other with non-magnetic sheets interposed therebetween to provide a predetermined leakage inductance. A plurality of CFLs can be turned on with only one outer core, thereby reducing the number of components, downsizing the device, and reducing the cost.

16 Claims, 13 Drawing Sheets

INVERTER TRANSFORMER

BACKGROUND OF THE INVENTION

1. Field of the Invention

The present invention relates to a step-up inverter transformer used in an output stage of an inverter for turning on a light source to illuminate a liquid crystal display.

2. Description of the Related Art

Recently, as display means for personal computers or the like, a liquid crystal display (hereinafter referred to as LCD) has been increasingly taking the place of a cathode ray tube (hereinafter referred to as CRT). The LCD, unlike the CRT, does not have a light emitting function, and therefore needs a backlight- or frontlight-type light source.

In order to illuminate an LCD screen brightly, two or more cold cathode fluorescent lamps (hereinafter referred to as CFL), which are simultaneously arc-discharged and lighted, may be used as the aforementioned light source.

In general, to discharge and light such CFLs, an inverter circuit is used in which a DC voltage of about 12 V is supplied through a Royer-type oscillator to the primary side of a transformer (inverter transformer) as an AC voltage, and in which a high frequency voltage of about 1600 V with 60 kHz is generated at the secondary side at the start of discharging.

After discharging of the CFLs, the inverter circuit controls the secondary-side voltage of the inverter transformer to be reduced to about 600 V required fir keeping the CFLs discharging. For this voltage control, pulse width modulation (hereinafter referred to as PWM) control is usually employed.

In such an inverter circuit, an open-magnetic-circuit inverter transformer using a bar-shaped core as a magnetic core, and a closed-magnetic-circuit inverter-transformer have been conventionally used.

FIG. 22 shows an equivalent circuit of an open-magnetic-circuit inverter transformer. In the figure, reference numerals 1, $L_1$, and $L_s$ denote an ideal step-up transformer (inverter transformer) with a winding ratio of 1:n and without loss, a leakage inductance, and an inductance of a secondary winding, respectively. When one CFL 2 is connected to the ideal step-up transformer (open-magnetic-circuit inverter transformer) 1, the leakage inductance $L_1$, works as a ballast inductance and discharges normally. However, when two CFLs 2 are connected in parallel to inverter transformer output terminals T, and when one CFL 2 of the two starts discharging before the other CFL 2, the voltage at the output terminals T is reduced due to the leakage inductance $L_1$, failing to allow the other CFL 2 to discharge.

FIG. 23 shows an example of the open-magnetic-circuit inverter transformer 1 which uses a bar-shaped core 3 as a magnetic core. The bar-shaped core 3 is inserted into a hollow 5 of a tubular bobbin 4 as shown by a dashed line. The bobbin 4 has a primary winding 6 and a secondary winding 7 wound thereon, and has a terminal block 9 with terminal pins 8 of the primary winding 6 and a terminal block 11 with terminal pins 10 of the secondary winding 7. Since the voltage induced at the secondary side is high, the secondary winding 7 is sectioned by partitions 12 provided on the bobbin 4 to prevent creeping discharge.

The open-magnetic-circuit inverter transformer 1 with the bar-shaped core 3 as a core is of a simpler structure than a closed magnetic circuit inverter transformer 1A, in which, as shown in FIG. 24, a rectangular frame-shaped core 13 and a bar-shaped core 3 are coupled to form a magnetic core, and primary and secondary windings 6 and 7 are provided on a bobbin 14 in which the bar-shaped core 3 is inserted. In the inverter transformer 1, however, since the leakage inductance is large, when a plurality of CFLs are connected thereto, it may happen that only one CFL is turned on with the rest failing to be turned on.

The closed-magnetic-circuit inverter transformer 1A shown in FIG. 24 is configured such that the bar-shaped core 3 is inserted in a hollow of the bobbin 14, the primary and secondary windings 6 and 7 are wound on the bobbin 14, and that the bobbin 14 is fitted into grooves 15 of the rectangular frame-shaped core 13.

The inverter transformer 1A shown in FIG. 24 may be configured as an open-magnetic-circuit type by providing a gap between the rectangular frame-shaped core 13 and the bar-shaped core 3, whereby the leakage inductance can be controlled. However, when a plurality of CFLs are connected in parallel, it may happen that all the CFLs are not turned on simultaneously. Accordingly, in an open-magnetic-circuit inverter transformer, one inverter transformer is necessary for each of the plurality of CFLs in order to turn on all the CFLs simultaneously.

When a plurality of CFLs are used in order to illuminate a screen of LCD brightly, a plurality of inverter transformers are required, resulting in an increased size as a whole and also an increased cost.

The open-magnetic-circuit inverter transformer using a bar-shaped core is of a simple structure, but has particularly a large leakage inductance, which generates a phase difference in the voltage and the current causing an increase in so-called reactive power, resulting in a substantial decrease in power efficiency.

On the other hand, in a closed-magnetic-circuit inverter transformer, two or more CFLs connected in parallel may all be discharged and turned on. In this case, however, when one CFL starts discharging, and a discharge current flows due to a decrease in the internal impedance of the CFL, thus increasing the load current, then the output voltage of the inverter transformer is reduced despite the small leakage inductance. This may affect discharge conditions of the other CFLs causing variation in the conditions.

Further, since the impedance of the CFLs has negative resistance characteristics, when one CFL starts discharging and turns on, then the impedance of the CFL is rapidly reduced and the current is increased sharply, whereby the inverter transformer may suffer damages, such as winding breakage or the like.

Accordingly, in the closed-magnetic-circuit inverter transformer, since the leakage inductance is small a ballast capacitor Cb is provided between an output terminal T and each of the CFLs 2, as shown in FIG. 25. However, this generates a phase difference between the voltage and the current thereby reducing the so-called reactive power resulting in decreased power efficiency and also invites a cost rise due to increased number of components and due to use of the costly ballast capacitors Cb.

As mentioned above, in the conventional open-magnetic-circuit inverter transformers, the number of inverter transformers increases with the increase in number of CFLs in a 1:1 relationship, thereby increasing the size of the inverter transformer as a whole and pushing up the cost.

In the dosed magnetic circuit structure, one inverter transformer may enable a plurality of CFLs to discharge but it happens that variation occurs in the discharge conditions among the CFLs, or eddy current damages the inverter transformer. The variation in the discharge conditions among the CFLs can be corrected by putting a ballast capacitor in series with each of the CFLs. However, this causes a decrease in power efficiency, an increase in the number of the components and an increase in cost.

SUMMARY OF THE INVENTION

The present invention aims to overcome the above problems. The object of the present invention is to provide a compact and less expensive inverter transformer that can simultaneously turn on a plurality of CFLs with a minimum increase in the number of components.

The present invention provides an inverter transformer, which is used in a DC to AC inverter, and adapted to step up an AC voltage inputted to a primary side thereof and to output to a secondary side. The inverter transformer includes an outer core shaped substantially like a rectangular frame, a plurality of inner cores shaped substantially like a bar, a plurality of secondary windings, a primary winding, and a plurality of bobbins shaped substantially like a tube. In the above, the plurality of inner cores are disposed inside the outer core and connected to the outer core so as to have a predetermined leakage inductance. The plurality of secondary windings are provided corresponding to the plurality of inner cores and the primary winding is provided to be common to the plurality of secondary windings. The plurality of bobbins are provided corresponding to the plurality of secondary windings, have the plurality of inner cores inserted therein, respectively, and have the plurality of secondary windings wound thereon, respectively. Furthermore, in the above, the plurality of bobbins each include a primary-side terminal block for the primary winding at one end thereof and a secondary-side terminal block for the secondary winding at the other end thereof are connected together for integration with the secondary windings wound thereon, and have the primary winding wound on the integrated bobbins.

In the above configuration of the present invention, the plurality of bobbins may be integrated such that the primary-side terminal blocks are connected to one another and the secondary-side terminal blocks are connected to one another. The primary-side terminal blocks may each have a projection and a groove for engagement at each connecting portion, and also the secondary-side terminal blocks may each have a projection and a groove for engagement at each connecting portion.

In all of the aforementioned configurations of the present invention, the outer core may be provided with grooves at its side, which engage with parts of the primary-side and secondary-side terminal blocks of the integrated bobbins.

In any one of the aforementioned configurations of the present invention, the primary-side and secondary-side terminal blocks of the integrated bobbins may be provided with projections for engaging with grooves formed on the outer core or with the outer portion of the outer core.

In any one of the aforementioned configurations of the present invention, the inner cores may be each shaped substantially like an L.

In any one of the aforementioned configurations of the present invention, the plurality of bobbins may be shaped identical to one another.

BRIEF DESCRIPTION OF THE DRAWINGS

The invention is explained with reference to the drawings, which are presented for the purpose of illustration only and in no way limit the invention.

DESCRIPTION OF THE PREFERRED EMBODIMENTS

Figure 1:
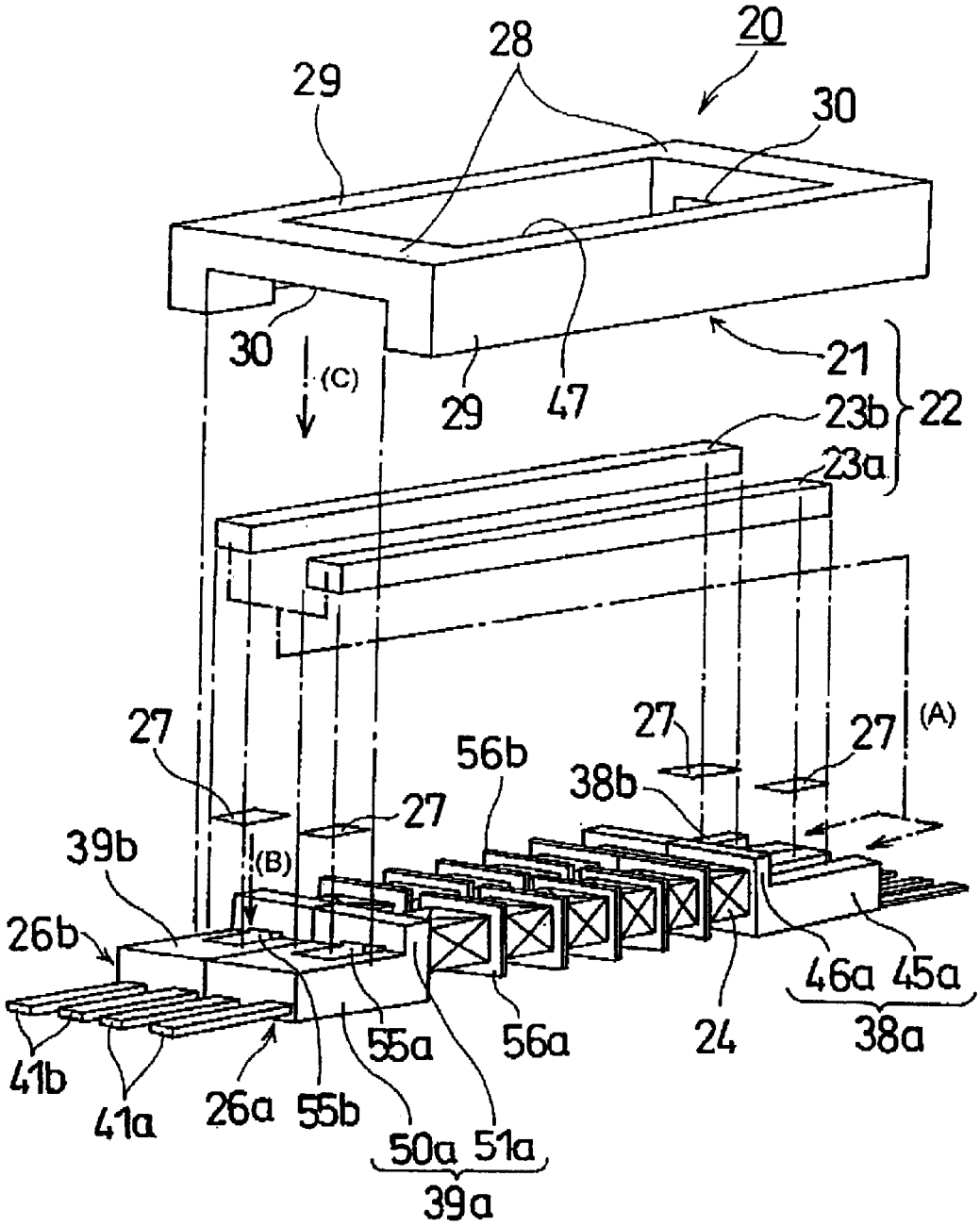
FIG. 1 is an exploded perspective view schematically showing an inverter transformer according to a first embodiment of the present invention.

An inverter transformer according to a first embodiment of the present invention will be explained with reference to FIGS. 1 to 8. Parts and members equivalent to those in FIGS. 22 to 25 are given the same reference numerals as in FIGS. 22 to 25, explanations for those being appropriately omitted.

Figure 2:
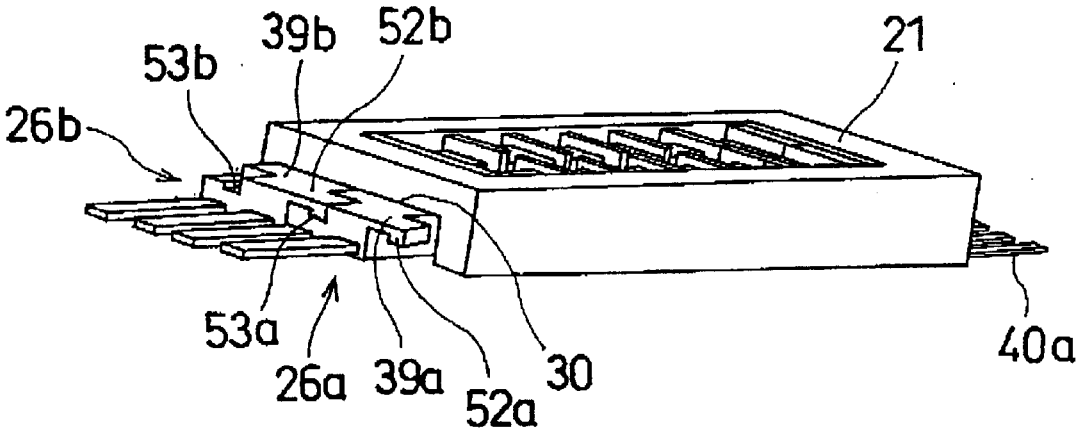
FIG. 2 is a perspective view schematically showing an assembled state of the inverter transformer shown in FIG. 1.
Figure 3:
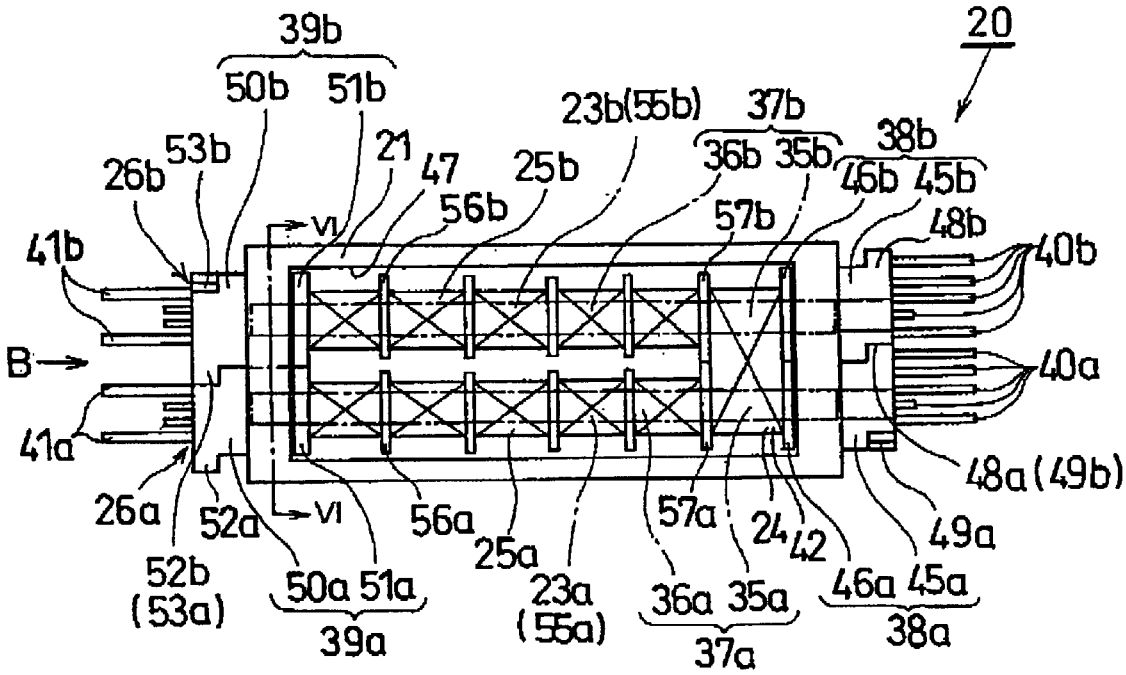
FIG. 3 is a plan view showing the inverter transformer shown in FIG. 1.

As shown in FIGS. 1 to 3, an inverter transformer 20 is generally composed of an outer core 21 shaped substantially like a rectangular frame, two inner cores 23*a* and 23*b* shaped substantially like a bar which together with the outer core form a magnetic core 22, a primary winding 24, two secondary windings 25*a* and 25*b*, a feedback winding 42 (FIG. 7) to be explained later, and two rectangular tubular bobbins 26*a* and 26*b* which are provided corresponding to the two secondary windings 25*a* and 25*b* and which have the primary winding 24, the feedback winding 42, and the two secondary windings 25*a* and 25*b* wound thereon.

The inverter transformer 20 is assembled in the following way. The inner cores 23*a* and 23*b* are, as shown by (A) in FIG. 1, inserted in the bobbins 26*a* and 26*b*, respectively, which are to be connected to each other for integration as explained below, non-magnetic sheets 27 (explained below) are placed on the inner cores 23*a* and 23*b* as shown by (B), and the core 21 is disposed thereon as shown by (C). In FIG. 1, for convenience sake, primary-side projections 48*a* and 48*b*, primary-side grooves 49*a* and 49*b*, secondary-side projections 52*a* and 52*b*, and secondary-side grooves 53*a* and 53*b* are not shown.

The two bobbins 26*a* and 26*b* are shaped identical to each other. Of the two bobbins 26*a* and 26*b*, one shown at the lower side in FIG. 3 is called a first bobbin 26*a*, and the other shown at the upper side in FIG. 3 is called a second bobbin 26*b*. Furthermore, for convenience sake, of the two inner cores 23*a* and 23*b*, one provided in the first bobbin 26*a* is denoted by 23*a*, and other provided in the second bobbin 26*b* is denoted by 23*b*.

The first and second bobbins 26*a* and 26*b* are combined for integration as explained below.

The two secondary windings 25*a* and 25*b* are wound on the first and second bobbins 26*a* and 26*b*, respectively, and the primary winding 24 is wound in common on the first and second bobbins 26*a* and 26*b* combined.

The two inner cores 23*a* and 23*b* are connected to the outer core 21 with the non-magnetic sheets 27 therebetween as explained below, so as to provide a predetermined leakage inductance.

Figure 4:
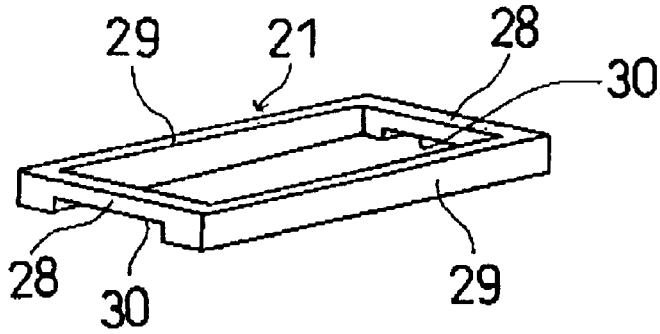
FIG. 4 is a perspective view showing an outer core shown in FIG. 1.
Figure 5:
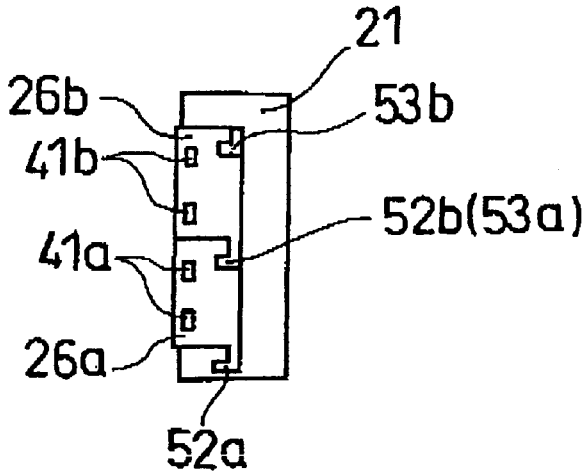
FIG. 5 is a side view along the direction of arrow B in FIG. 3.

The outer core 21 includes two shorter sides 28 and two longer sides 29 both in the form of quadratic prism as shown in FIGS. 1 and 4. The shorter sides 28 each have a groove 30 on its one face, and primary-side terminal blocks 38*a* and 38*b*, and secondary-side terminal blocks 39*a* and 39*b* explained below are fitted into respective grooves 30 for engagement.

Next, the structures of the first and second bobbins 26*a* and 26*b* will be explained. As mentioned above, the first and second bobbins 26*a* and 26*b* are identically structured, so only the structure of the first bobbin 26*a* will be explained with the structure of the second bobbin being explained only collaterally with the first bobbin 26*a*. The individual constituents of the second bobbin 26*b* will be explained with appropriate omission.

As shown in FIG. 3, the first bobbin 26*a* includes a trunk 37*a* which has a primary winding portion 35*a* where the primary winding 24 is provided and a secondary winding portion 36*a* where the secondary winding 25*a* is provided, and the primary-side and secondary-side terminal blocks 38*a* and 39*a* which are disposed at one and the other ends of the trunk 37*a*, respectively.

Figure 7:
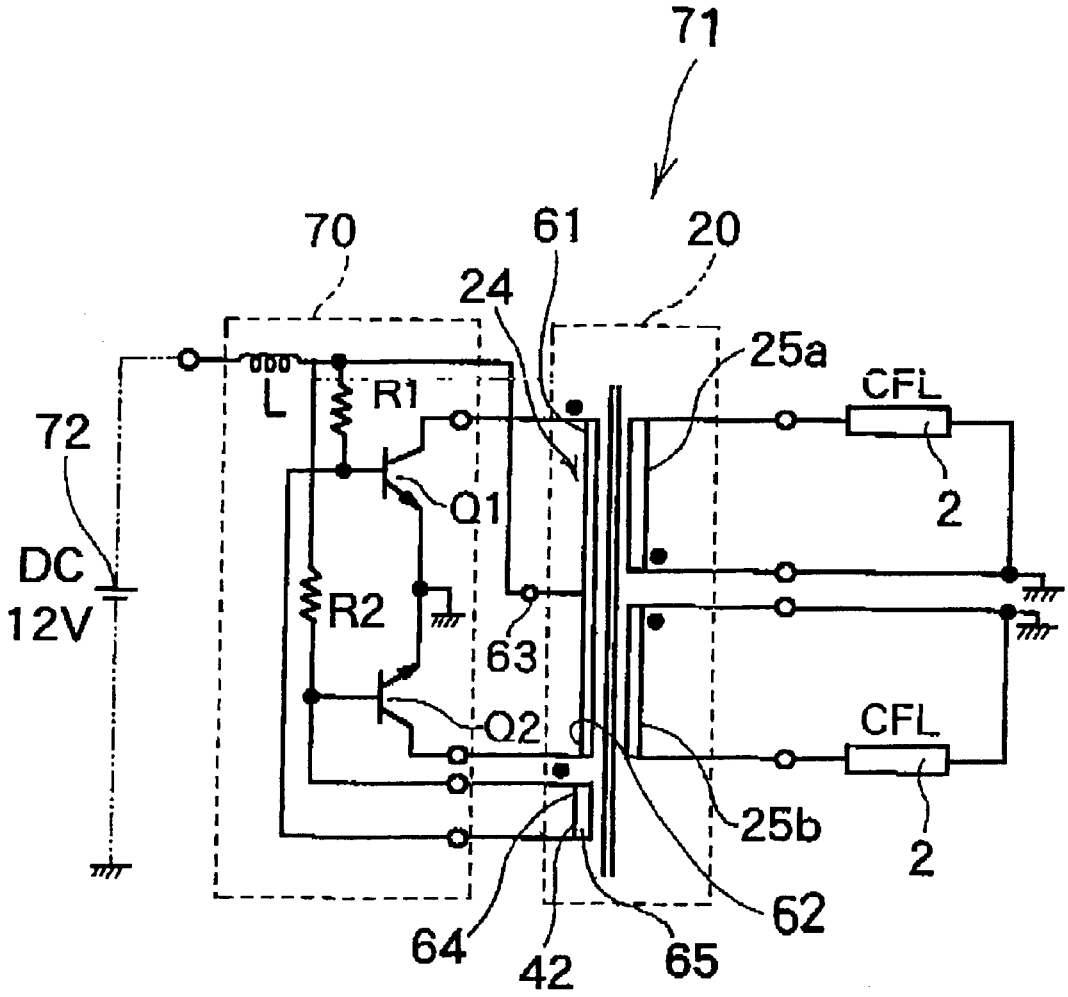
FIG. 7 is a circuit diagram in which CFLs are connected to the inverter transformer shown in FIG. 1.

One face (the right side in FIG. 3) of the primary-side terminal block 38*a* is provided with five primary winding terminal pins 40*a*. As shown in FIG. 7, three of the five primary winding terminal pins 40*a* are for push-pull connection at the prima side (specifically for a starting end 61, a terminating end 62, and an intermediate tap 63 of the primary winding 24) of the inverter transformer 20, and the rest thereof are for the feedback winding 42 (specifically for a starting end 64 and a terminating end 65).

The feedback winding 42 is disposed approximately at the same position (FIGS. 1 and 3) as the primary winding 24, both ends thereof being connected to two of five pins of respective primary winding terminal pins 40*a* and 40*b*. The feedback winding 42 is omitted in FIGS. 1 and 3.

One face (the left side in FIG. 3) of the secondary-side terminal block 39*a* is provided with two secondary winding terminal pins 41*a*.

As shown in FIGS. 1 and 3, the primary-side terminal block 38*a* includes a primary-side terminal block body 45*a* shaped substantially rectangular and provided with the primary winding terminal pins 40*a*, and a primary-side terminal block flange 46*a* formed on the primary-side terminal block body 45*a* at a side connected with the trunk 37*a*. The primary-side terminal block 38*a* is shaped substantially like an L when viewed from the side and has a width (the dimension in an vertical direction in FIG. 3) substantially equal to one half of the width (the dimension in the vertical direction in FIG. 3) of a rectangular space 47 of the outer core 21.

A projection (hereinafter referred to as primary-side terminal block projection) 48*a* shaped substantially like an L in section is formed on one side (upper side in FIG. 3) of the primary-side terminal block body 45*a* toward a surface having the primary-side terminal block flange 46*a* and toward an end having the primary winding terminal pins 40*a*, while a groove (hereinafter referred to as primary-side terminal block groove) 49*a* configured so as to match the primary-side terminal block projection 48*a* is formed on the other side (lower side in FIG. 3).

Also, as shown in FIGS. 1 and 3, the secondary-side terminal block 39*a* includes a secondary-side terminal block body 50*a* shaped substantially rectangular and provided with the secondary winding terminal pins 41*a*, and a secondary-side terminal block flange 51*a* formed on the secondary-side terminal block body 50*a* at a side connected with the trunk 87*a*. The secondary-side terminal block 39*a* is shaped substantially like an L when viewed from the side and has a width (the dimension in the vertical direction in FIG. 3) substantially equal to one half of the width (the dimension in the vertical direction in FIG. 3) of the rectangular space 47 of the outer core 21.

A projection (hereinafter referred to as secondary-side terminal projection) 52*a* shaped substantially like an L in section is formed on one side (lower side in FIG. 3) of the secondary-side block body 50*a* toward a surface having the secondary-side terminal block flange 51*a* and toward an end having the secondary winding terminal pins 41*a*, while a groove (hereinafter referred to as secondary-side terminal block groove) 53*a* configures so as to match the secondary-side terminal projection 52*a* is formed on the other side (upper side in FIG. 3).

The first bobbin 26*a* is integrated with the second bobbin 26*b*. The portion from the primary-side terminal block flange 46*a* to the secondary-side terminal block flange 51*a* is disposed in the space 47 of the outer core 21. The primary-side terminal block body 45*a* and the secondary-side terminal block body 50*a* engage with the grooves 30 of the outer core 21 at sides toward their respective terminal block flanges 46*a* and 51*a*.

The first bobbin 26*a* has a hollow 55*a* extending from the primary-side terminal block body 45*a* partway toward the secondary-side terminal block body 50*a*, and the inner core 23*a* is inserted therein. The hollow 55*a* is fully open at the upper face of the primary-side terminal block body 45*a* and partly open at the upper face of the secondary-side terminal block body 50*a*.

Figure 6:
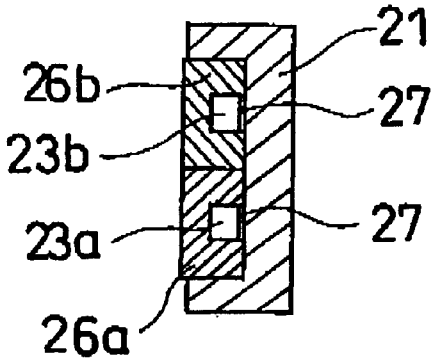
FIG. 6 is a sectional view taken along line VI—VI in FIG. 3.

The first bobbin 26*a* is integrated with the second bobbin 26*b* as mentioned above, and the primary-side and secondary-side terminal blocks 38*a* and 39*a* engage with the grooves 30 of the outer core 21 with the non-magnetic sheets 27 interposed between the shorter sides 28 of the outer core 21 and the inner core 23*a* inserted in the hollow 55*a* as shown in FIGS. 1 and 6.

The secondary winding 25*a* is wound along the length of the first bobbin 26*a* (the inner core 23*a*) and is divided lengthwise into a plurality of sections (five sections in the present embodiment) against the generation of high voltage such that a secondary winding partition 56*a* is provided between respective adjacent sections to secure a creeping distance necessary to inhibit creeping discharge. The secondary winding partition 56*a* is provided with a notch (not shown), through which a wire passes which connects the adjacent sections of the secondary winding 25*a* that sandwich the partition 56*a*.

The primary-side terminal block 38*a* is provided with holes (not shown) or grooves (not shown) for passing lead wires (not shown) connecting the primary winding 24 and the primary winding terminal pins 40*a*. The lead wires, covered with an insulator, are let through the holes or embedded in the grooves to secure a sufficient creeping distance and insulation.

And, the secondary-side terminal block 39*a* is provided with holes (not shown) or grooves (not shown) for passing lead wires (not shown) connecting the secondary winding 25*a* and the secondary winding terminal pine 41*a*. The lead wires, covered with an insulator, are let through the holes or embedded in the grooves to secure a sufficient creeping distance and insulation.

Grounding lead wires of the secondary winding 25*a* are routed under the primary winding 24 to connect with the primary winding terminal pins 40*a*, which does not require the first bobbin 26*a* to have the aforementioned holes or grooves for the lead wires thereby easing the fabrication of the first bobbin 26*a*.

A primary winding partition 57*a* is provided between the primary winding portion 35*a* and the secondary winding portion 36*a* of the first bobbin 26*a*. The primary winding partition 57*a* is designed such that a dimension in a direction perpendicular to the length of the first bobbin 26*a* (vertical direction in FIG. 3) is larger compared with that of the secondary winding partition 56*a*, whereby when the first bobbin 26*a* is integrated with the second bobbin 26*b*, the primary winding partition 57*a* of the first bobbin 26*a* comes into contact with a primary winding partition 57*b* of the second bobbin 26*b* while a gap is formed between the secondary winding partition 56*a* of the first bobbin 26*a* and a secondary winding partition 56*b* of the second bobbin 26*b* as shown in FIG. 3.

The second bobbin 26*b* is shaped identical with the first bobbin 26*a* as mentioned above. Accordingly, elements of the second bobbins 2*b* equivalent to those of the first bobbin 26*a* are indicated with same numbers but suffixed with "b" instead of "a" (for instance, the primary winding portion of the second bobbin 26*b* corresponding to the primary winding portion 35*a* of the first bobbin 26*a* is indicated by 35*b*), and an explanation of each element is omitted.

The first and second bobbins 26*a* and 26*b* are integrated with each other, with respective secondary windings 25*a* and 25*b* wound thereon, such that the primary-side terminal block projection 48*a* and the secondary-side terminal block groove 53*a* of the first bobbin 26*a* engage with the primary-side terminal block groove 49*b* and the secondary-side terminal block projection 52*b*, respectively, of the second bobbin 26*b*.

The primary winding portion 85*a* of the first bobbin 26*a* and the primary winding portion 35*b* of the second bobbin 26*b* have the primary winding 24 wound thereat in common.

In this case, the inner core 23*a* inserted in the hollow 55*a* of the first bobbin 26*a* and the inner core 23*b* inserted in the hollow 55*b* of the second bobbin 26*b* are positioned to be electromagnetically equal to each other with respect to the outer core 21 and fixed thereto with the non-magnetic sheets 27 interposed therebetween so that the inner cores 28*a* and 28*b* can be electromagnetically coupled with the primary winding 24 with their respective characteristics identical with each other.

The first and second bobbins 26*a* and 26*b*, which are integrated and have the primary winding 24, the feedback winding 42, the secondary windings 25*a* and 25*b*, and the inner cores 23*a* and 23*b* provided thereon, are fixed to the outer core 21 by adhesive such that the primary-side terminal blocks 38*a* and 38*b* engage with one groove 30 (the right side in FIG. 1) and the secondary-side terminal blocks 39*a* and 39*b* engage with the other groove 30 (the left side in FIG. 1).

In the first embodiment, since the first and second bobbins 26*a* and 26*b* are shaped identical with each other, a same die may be used in common, whereby manufacturing costs can be reduced. The first and second bobbins 26*a* and 26*b*, however, do not have to be shaped identical with each other.

In the inverter transformer 20 thus configured, the secondary windings 25*a* and 25*b* are both electromagnetically coupled with the primary winding 24 and at the same time are electromagnetically equivalent to each other. In addition, the two inner cores 23*a* and 23*b* and the outer core 21 have the non-magnetic sheets 27 interposed therebetween, and therefore the inverter transformer 20 has the primary and the secondary sides magnetically coupled to each other with a predetermined leakage inductance therebetween.

In the inverter transformer 20 thus configured, magnetic fluxes $\phi 1$ and $\phi 2$ (not shown) generated by a current flowing in the primary winding 24 flow in the same direction in the inner cores 23*a* and 28*b* and therefore flow into the outer core 21 without interfering with each other. Accordingly, since the present inverter transformer 20 has the secondary windings 25*a* and 25*b* independent of each other while having the primary winding 24 in common, two CFLs can be successfully driven simultaneously.

When two CFLs 2 are to be driven, two outer cores may be disposed corresponding to the two inner cores 23*a* and 28*b* (secondary windings 25*a* and 25*b*). The present inverter transformer 20, however, has only one outer core 21 being common to the inner cores 23*a* and 23*b* (secondary windings 25*a* and 25*b*) and magnetically coupled therewith to drive two CFLs 2, whereby the number of components is reduced contributing to downsizing and cost reduction.

A circuit where two CFLs 2 are connected to the aforementioned inverter transformer 20 is shown in FIG. 7. In the circuit shown in FIG. 7, the inverter transformer 20 and a Royer-type oscillator 70 constitute an inverter 71.

In FIG. 7, the Royer-type oscillator 70, with a voltage supplied from a DC power supply 72, generates a high frequency voltage. In the inverter transformer 20, the high frequency voltage is supplied to the push-pull-type primary winding 24 and is stepped up at the secondary windings 25*a* and 25*b*. The stepped-up voltage is then applied to the two CFLs 2 connected to the secondary windings 25*a* and 25*b*, thereby discharging and turning on the two CFLs 2.

Figure 8A:
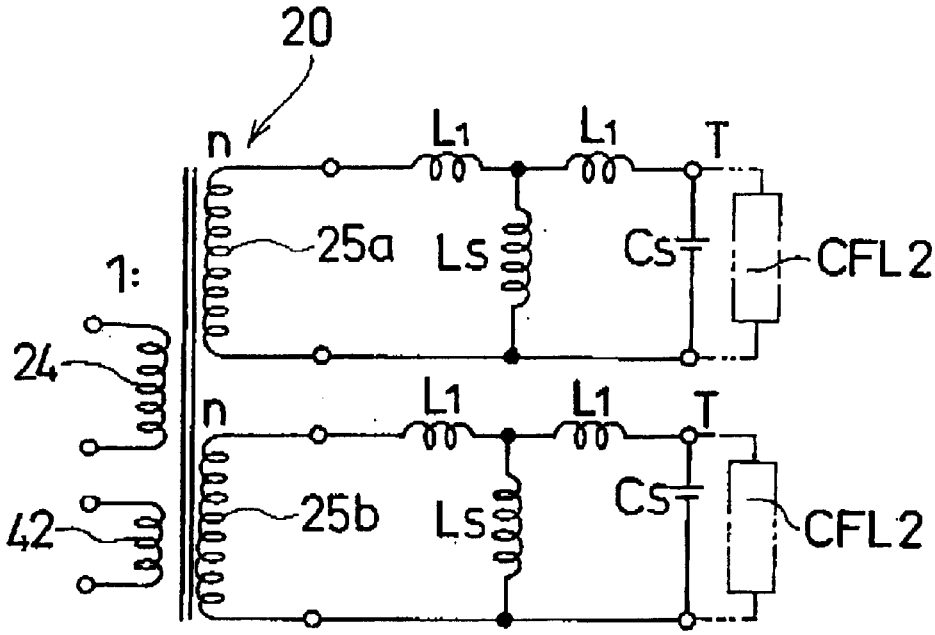
FIGS. 8A and 8B axe diagrams each showing an equivalent circuit of the inverter transformer shown in FIG. 1.
Figure 8B:
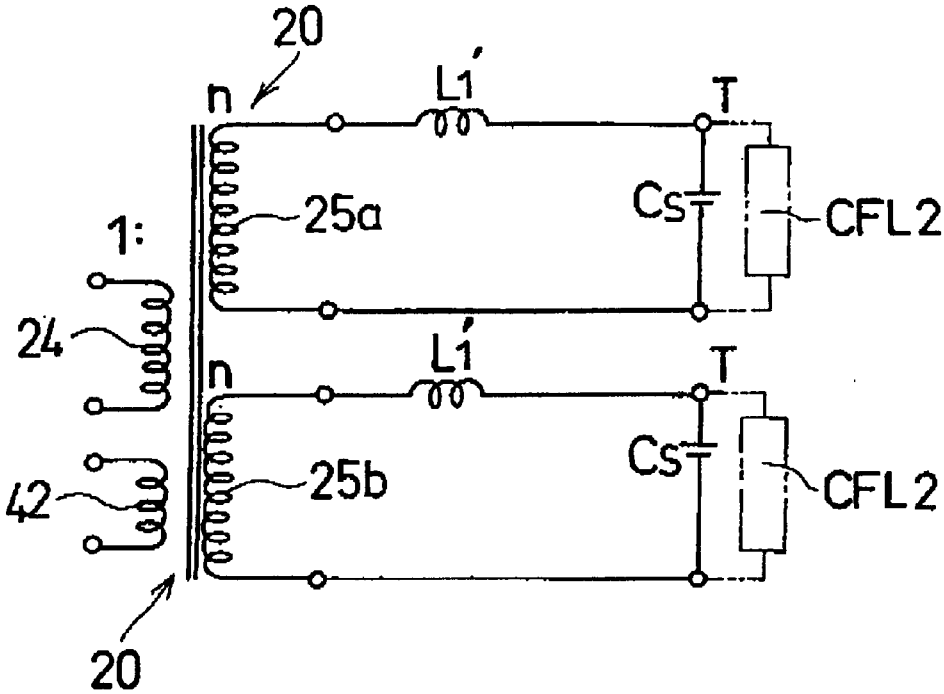

The inverter transformer 20 of FIG. 7 can be shown by an equivalent circuit of FIG. 8A or an equivalent circuit of FIG. 8B, which is a simplification of the equivalent circuit of FIG. 8A In FIGS. 8A and 8B, Cs indicates parasitic capacitance of an LCD (liquid crystal display unit).

In the equivalent circuit shown in FIG. 8A, a main inductance Ls of the inverter transformer 20 generally shows an increased impedance at a frequency at which the CFL is turned on. Accordingly, even if the equivalent circuit of FIG. 8B replaces the equivalent circuit of FIG. 8A, the error is insignificant, and there should be no problem in using the equivalent circuit of FIG. 8B to investigate the characteristics of the inverter transformer 20 shown in FIG. 7.

As shown in FIGS. 8A and 8B, the secondary windings 25*a* and 25*b* are common to the primary winding 24 but independent of each other and electromagnetically equivalent to each other. That is, as shown in FIG. 81, the CFLs 2 are connected, via respective leakage inductances $L_{1'}$ and $L_{s'}$, to prescribed circuits (circuits corresponding to the main inductances Ls shown in FIG. 8A, not shown in FIG. 8B representing the simplified circuit) which are equivalent to each other.

As mentioned above, even when any one of the two CFLs 2 is turned on earlier than the other, the output voltage (voltage at an output T) of either of the secondary windings 25*a* and 25*b* connected to the other CFL 2 does not drop thereby not affecting the discharge conditions of the other CFL 2. Therefore, it can happen that one of the two CFLs 2 is first discharged and turned on, then the other is discharged and turned on normally without using an expensive ballast capacitor with a high breakdown voltage (ballast capacitor Cb shown in FIG. 25, for instance).

In the conventional technology, in order to turn on a plurality of CFLs, a plurality of inverter transformers or ballast capacitors are required. According to the first embodiment of the present invention, two CFLs 2 can be driven normally with only one inverter transformer 20 and without the ballast capacitors, whereby the device can be simplified and produced with reduced cost. This applies to all further embodiments to be explained below.

When the CFLs 2 are driven with the frequency set at a resonant frequency formed by the leakage inductance $L_1'$ and the parasitic capacitance Cs of the inverter transformer 20 shown in the equivalent circuit in FIG. 8B, the CFLs 2 turn on at a voltage of about 600 V as a secondary output voltage, which is normally required to be 1000 V or more. If the second windings 25*a* and 25*b* undergo layer shortcut, the leakage inductance changes, whereby the CFLs 2 are not supplied with power and the output voltage drops preventing smoking and firing.

In the first embodiment of the present invention, two inner cores 23*a* and 23*b* (secondary windings 25*a* and 25*b*) are provided to drive two CFLs 2. Alternatively, in case of driving three or more CFLs 2, three or more inner cores (secondary windings) may be provided. This applies to an of the further embodiments explained below.

Next, an inverter transformer according to a second embodiment of the present invention will be explained with reference to FIGS. 9 to 13. The pasts and members equivalent to those of FIGS. 1 to 8 and FIGS. 22 to 25 are given the equivalent reference numerals, and an explanation thereof is thus omitted.

The second embodiment includes first and second bobbins 74*a* and 74*b* in place of the first and second bobbins 26*a* and 26*b* included in the first embodiment.

Figure 11:
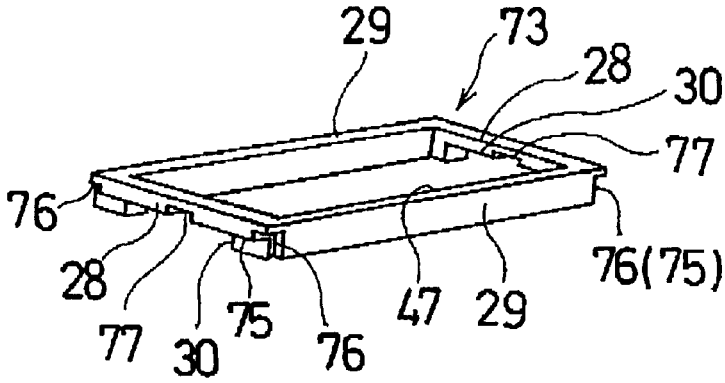
FIG. 11 is a perspective view showing an outer core shown in FIG. 9.
Figure 12:
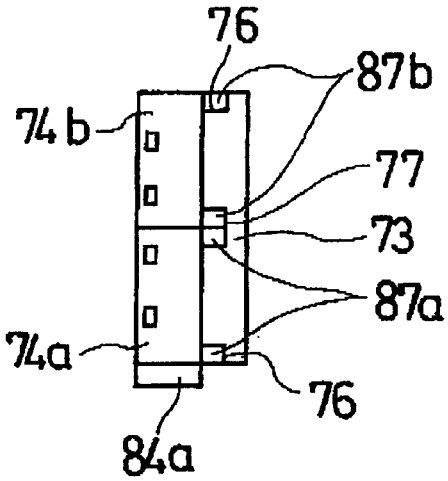
FIG. 12 is a side view along the direction of arrow B in FIG. 10.
Figure 13:
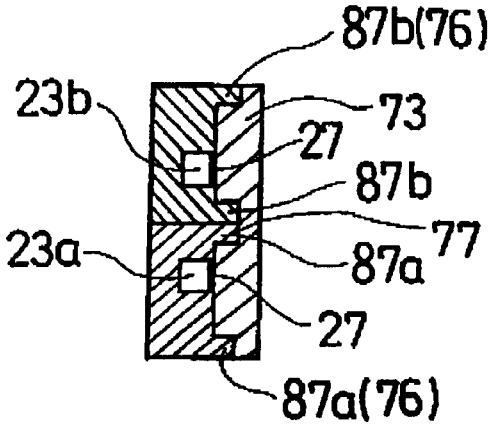
FIG. 13 is a sectional view taken along line XIII—XIII in FIG. 10.

An outer core 73 corresponding to the outer core 21 in the first embodiment has notches 75 formed respectively at the lower portions of shorter sides 28 and extending along the shorter sides 28 as shown in FIG. 11. Furthermore, the outer core 73 has grooves (hereinafter referred to as corner grooves) 76 formed respectively at its four corners and grooves (hereinafter referred to as center grooves) 77 formed respectively at the center of the lower faces of the shorter sides 28 as shown in FIGS. 11 to 13.

Figure 10:
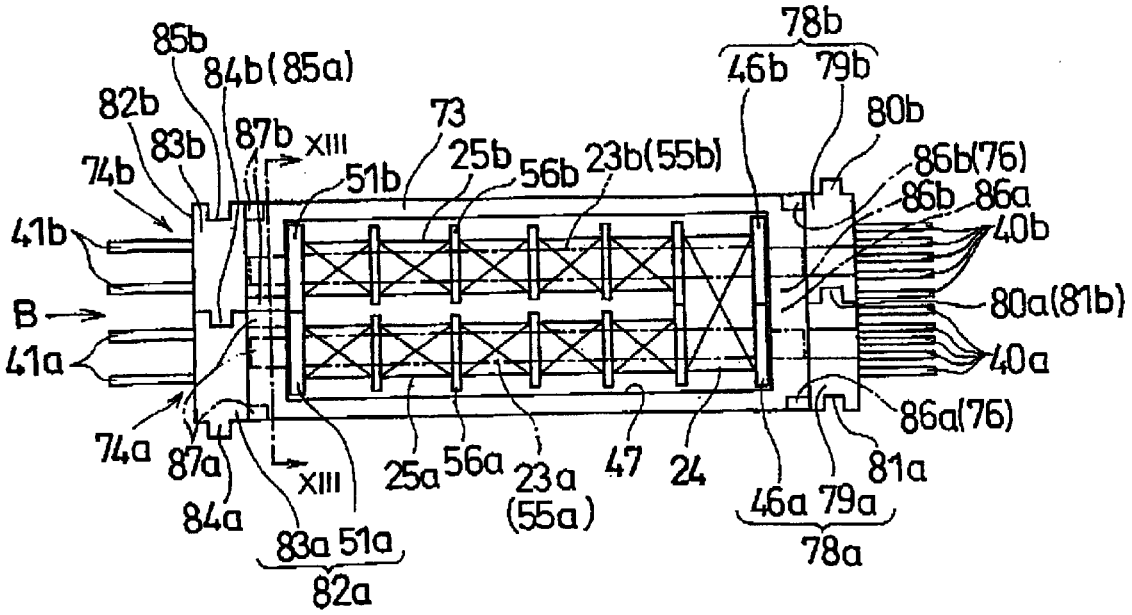
FIG. 10 is a plan view showing the inverter transformer shown in FIG. 9.

The first and second bobbins 74*a* and 74*b* are provided with primary-side terminal blocks 78*a* and 78*b*, respectively, as shown in FIG. 10. The primary-side terminal blocks 78*a* and 78*b* include primary-side terminal block bodies 79*a* and 79*b* and primary-side terminal block flanges 46*a* and 46*b* continuous therewith, respectively.

The width (dimension in the vertical direction in FIG. 10) of the primary-side terminal block flanges 46*a* and 46*b* is approximately equal to one half of the width (dimension in the vertical direction in FIG. 10) of a rectangular space 47 of the outer core 73.

Figure 9:
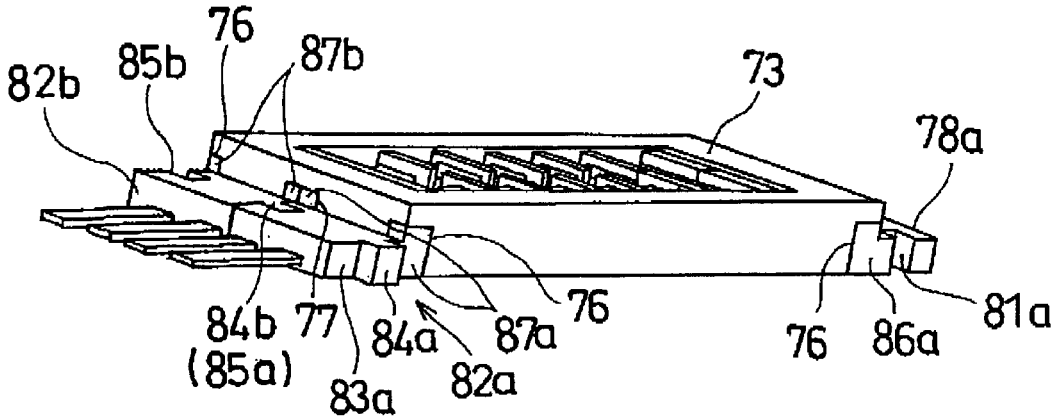
FIG. 9 is a perspective view showing an inverter transformer according to a second embodiment of the present invention.

The primary-side terminal block body 79*a* has a rectangular projection (hereinafter referred to as primary-side terminal block projection) 80*a* formed on one face (upper side in FIG. 10), and a groove (hereinafter referred to as primary-side terminal block groove) 81*a* formed on the other face (lower side in FIG. 10) and configured to match the primary-side terminal block projection 80*a* as shown in FIG. 9. The primary-side terminal block body 79*b* has a primary-side terminal block projection 80*b* and a primary-side terminal block groove 81*b* corresponding to the primary-side terminal block projection 80*a* and the primary-side terminal block grooves 81*a*, respectively.

Further, the first and second bobbins 74*a* and 74*b* include secondary-side terminal blocks 82*a* and 82*b*, respectively. The secondary-side terminal blocks 82*a* and 82*b* include secondary-side terminal block bodies 83*a* and 83*b* and secondary-side terminal block flanges 51*a* and 51*b* continuous therewith, respectively.

The width (dimension in the vertical direction in FIG. 10) of the secondary-side terminal block flanges 51*a* and 51*b* is approximately equal to one half of the width (dimension in the vertical direction in FIG. 10) of the rectangular space 47 of the outer core 73.

The secondary-side terminal block body 83*a* has a rectangular projection. Hereinafter referred to as secondary-side terminal block projection) 84*a* formed on one face (lower side in FIG. 10), and a groove (hereinafter referred to as secondary-side terminal block groove) 85*a* formed on the other face (upper side in FIG. 10) and configured to match the secondary-side terminal block projection 84*a*. The secondary-side terminal block body 83*b* has a secondary-side terminal bloc projection 84*b* and a secondary-side terminal block groove 85*a* corresponding to the secondary-side terminal block projection 84*a* and the secondary-side terminal block groove 85*a*, respectively.

Primary-side sub-projections 86*a* for engaging with the corner groove 76 and the center groove 77 of the outer core 73 are each provided at both sides of the primary-side terminal block body 79*a* toward the primary-side terminal block flange 46*a* (near the primary-side terminal block groove 81*a* and the primary-side terminal block projection 80*a*.

Similarly, primary-side sub-projections 86*b* for engaging with the corner groove 76 and the center groove 77 of the outer core 73 are each provided at both sides of the primary-side terminal block body 79*b* toward the primary-side terminal block flange 46*b*.

Secondary side sub-projections 87*a* for engaging with the corner groove 76 and the center groove 77 of the outer core 73 are each provided at both sides of the secondary-side terminal block body 83*a* toward the secondary-side terminal block flange 51*a* (near the secondary-side terminal block projection 84*a* and the secondary-side terminal block groove 86*a*.

Similarly, secondary-side sub-projections 87*b* for engaging with the corner groove 76 and the center groove of the outer core 73 are each provided at both sides of the secondary-side terminal block body 83*b* toward the secondary-side terminal block flange 51*b*.

The first and second bobbins 74*a* and 74*b* of the second embodiment are put together for integration with the secondary windings 25*a* and 25*b* being wound thereon. In this case, the primary-side terminal block projection 80*a* and the secondary-side terminal block groove 85*a* of the first bobbin 74*a* engage with the primary-side terminal block groove 81*b* and the secondary-side terminal block projection 84*b* of the second bobbin 74*b*, respectively, thereby fixing together the first and second bobbins 74*a* and 74*b*.

The primary winding 24 is wound in common at both the primary winding portion 85*a* of the first bobbin 74*a* and the primary winding portion 35*b* of the second bobbin 74*b* integrated with the first bobbin 74*a*.

In this case, the inner core 23*a* inserted in the hollow 55*a* of the first bobbin 74*a* and the inner core 23*b* inserted in the hollow 55*b* of the second bobbin 74*b* are positioned to be electromagnetically equal to each other with respect to the outer core 73 and are fixed thereto with the non-magnetic sheets 27 interposed therebetween so that the inner cores 23*a* and 23*b* can be electromagnetically coupled with the primary winding 24 with characteristics equal to each other.

The first and second bobbins 74*a* and 74*b* integrated with each other are fixed to the outer core 73 with the primary winding 24, the feedback winding 42 (FIG. 7), the secondary windings 25*a* and 25*b*, and the inner cores 23*a* and 23*b* provided thereon. In this case, the first and second bobbins 74*a* and 74*b* are combined with each other such that the primary-side terminal blocks 78*a* and 78*b* engage with one groove 30 (right side in FIG. 10) and the secondary-side terminal blocks 82*a* and 82*b* engage with the other groove 30 (left side in FIG. 11) in the same way as the first embodiment.

Furthermore, in the second embodiment, the primary-side sub-projection 86*a* of the primary-side terminal block body 79*a*, the primary-side sub-projection 86*b* of the primary-side terminal block body 79*b*, the secondary-side sub-projection 87*a* of the secondary-side terminal block body 83*a*, and the secondary-side sub-projection 87*b* of the secondary-side terminal block body 83*b* engage with the corner grooves 76 of the outer core 73. Furthermore, the primary-side sub-projection 86*a* of the primary-side terminal block body 79*a* and the primary-side sub-projection 86*b* of the primary-side terminal block body 79*b* are connected to each other and engage with the center groove 77 at the center of one shorter side. Similarly, the secondary-side sub-projection 87*a* of the secondary-side terminal block body 83*a* and the secondary-side sub-projection 87*b* of the secondary-side terminal block body 83*b* are connected to each other and engage with the center groove 77 at the center of the other shorter side.

The first and second bobbins 74*a* and 74*b* integrated with each other are fixed by adhesive to the outer core 73 with the non-magnetic sheet 27 interposed between the two inner cores 23*a* and 23*b* and the outer core 73.

In the present second embodiment, the first and second bobbins 74*a* and 74*b* integrated with each other are fixed to the outer core 73, not only such that, as in the first embodiment, the primary-side terminal blocks 78*a* and 78*b* engage with one groove 30 (right side in FIG. 11), and the secondary-side terminal blocks 82*a* and 82*b* engage with the other groove 30 (left side in FIG. 11), but also such that the primary-side sub-projection 86*a*, the primary-side sub-projection 86*b*, the secondary-side sub-projection 87*a*, and the secondary-side sub-projection 87*b* engage with the corner grooves 76, the primary-side sub-projections 86*a* and 86*b* connected to each other engage with the center groove 77 at the center of the shorter side, and the secondary-side sub-projections 87*a* and 87*b* connected to each other engage with the center groove 77 at the center of the shorter side, thereby realizing firmer fixation.

Furthermore, in the second embodiment, the first and second bobbins 74*a* and 74*b* are shaped identical with each other, which allows a same die to be used in common, thereby reducing the manufacturing costs.

Figure 14:
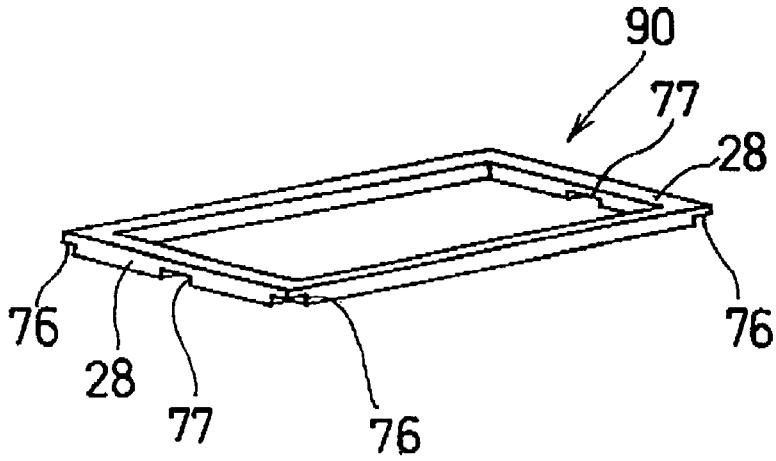
FIG. 14 is a perspective view showing another outer core (third embodiment) in place of the outer core shown in FIG. 9.

Also, if the first and second bobbins 74*a* and 74*b* are fixed to the outer core 73 by adhesive, then the outer core 73 (FIG. 11) may be replaced by an outer core 90 configured as shown in FIG. 14 (third embodiment). The outer core 90 eliminates the grooves 30 so as to be smaller in thickness, and also eliminates the notches 75 (FIG. 11) thereby simplifying the configuration.

In the third embodiment, the first and second bobbins 74*a* and 74*b* (FIG. 10) are fixed to the outer core 90 by use of adhesive and at the same time fixed thereto in such a manner that the primary-side sub-projection 86*a*, the primary-side sub-projection 86*b*, the secondary-side sub-projection 87*a*, and the secondary-side sub-projection 87*b* engage with the corner grooves 76, the primary-side sub-projections 86*a* and 86*b* connected to each other engage with the center groove 77 at the center of the shorter side, and the secondary-side sub-projections 87*a* and 87*b* connected to each other engage with the center groove 77 at the center of the shorter side FIGS. 10 to 13).

In the third embodiment, the outer core 90 eliminates the grooves 30 and the notches 76 of the outer core 73 (FIG. 11) of the second embodiment, resulting in a simpler configuration and therefore can be easily produced, thereby improving productivity.

Next, an inverter transformer according to a fourth embodiment of the present invention will be explained with reference to FIGS. 15 to 19. The parts and members identical to FIGS. 1 to 14 and FIGS. 22 to 25 are given the same reference numerals as FIGS. 1 to 14 and FIGS. 22 to 25, and an explanation thereof is thus omitted.

Figure 15:
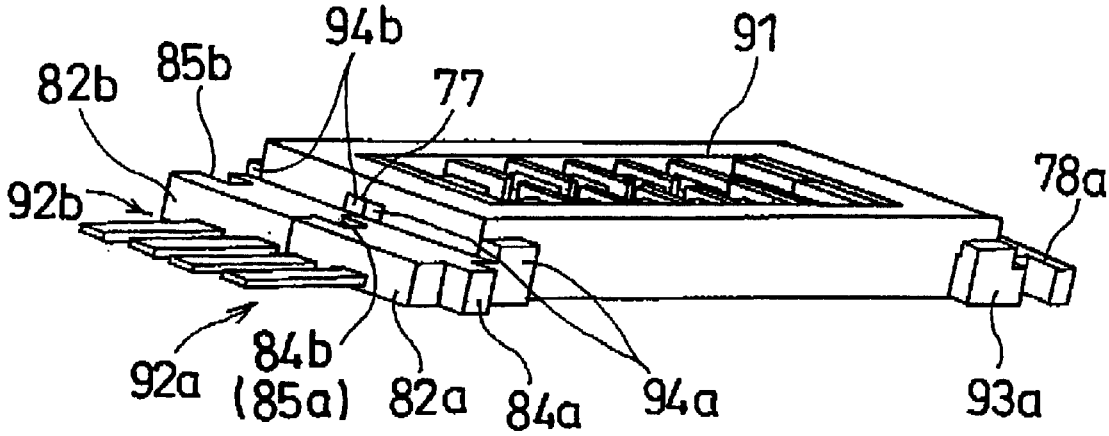
FIG. 15 is a perspective view showing an inverter transformer according to a fourth embodiment of the present invention.
Figure 16:
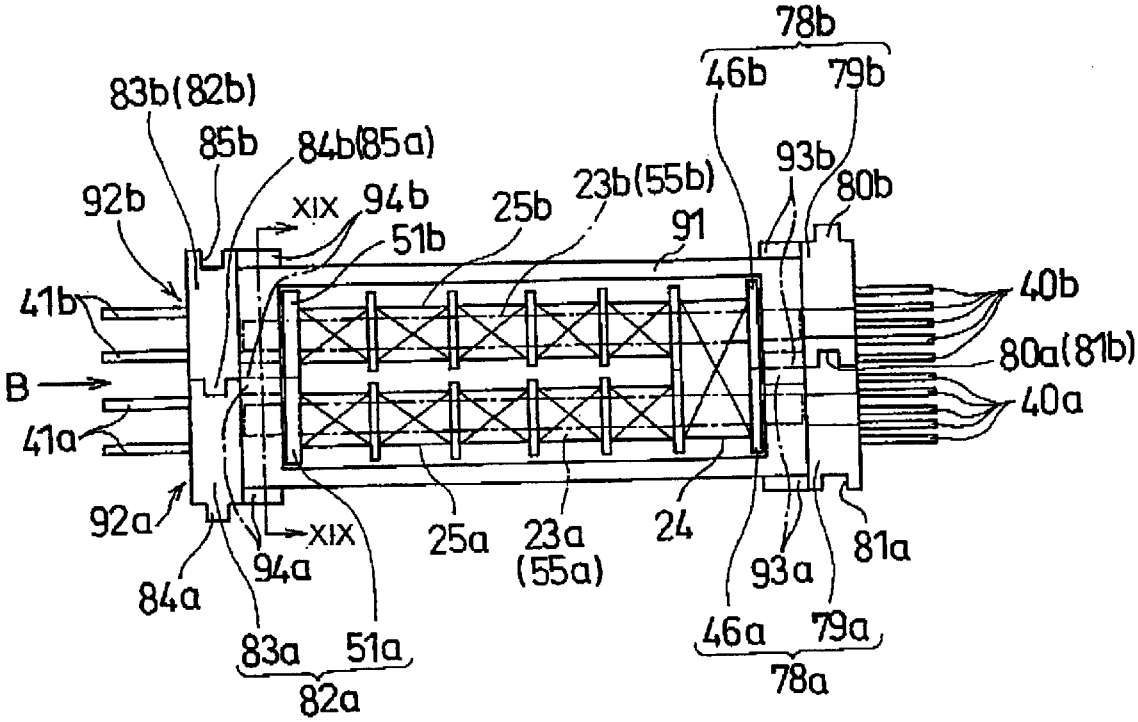
FIG. 16 is a plan view showing the inverter transformer shown in FIG. 15.
Figure 17:
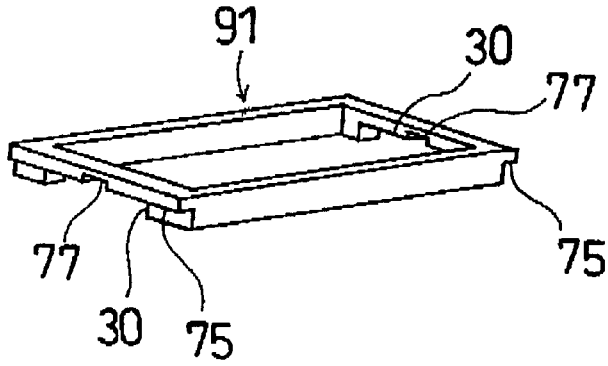
FIG. 17 is a perspective view showing the outer core shown in FIG. 15.
Figure 18:
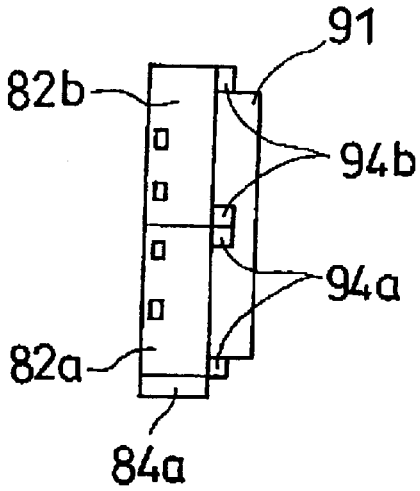
FIG. 18 is a side view along the direction of arrow B in FIG. 16.
Figure 19:
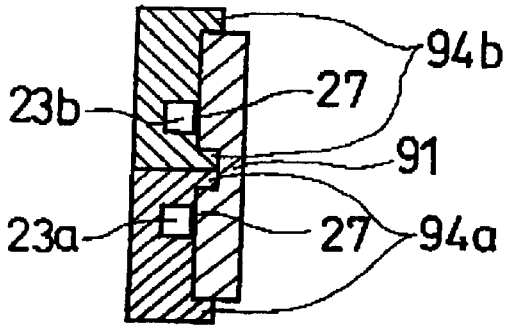
FIG. 19 is a sectional view taken along line XIX—XIX in FIG. 16.

The fourth embodiment is mainly different from the second embodiment in the following points. Firstly, as shown in FIGS. 15 to 17, the outer core 73 is replaced by an outer core 91 which eliminates the corner grooves 76 of the outer core 73. Secondly, as shown in FIGS. 15 and 16, first and second bobbins 92*a* and 92*b* are provided in place of the first and second bobbins 74*a* and 74*b*. Thirdly, as shown in FIGS. 16, 18 and 19, primary-side sub-projections 93*a* and 93*b* and secondary-side sub-projections 94*a* and 94*b*, in place of the primary-side sub-projections 86*a* and 86*b* and the secondary-side sub-projections 87*a* and 87*b* of the first and second bobbins 74*a* and 74*b*, are provided in the first and second bobbins 92*a* and 92*b*, respectively.

As shown in FIGS. 15 and 16, primary-side sub-projections 93*a* are provided on both sides of the primary-side terminal block body 79*a* toward the primary-side terminal block flange 46*a* (near the primary-side terminal block groove 81*a* and the primary-side terminal block projection 80*a*) so as to project out of the plane of FIG. 16. One (lower side in FIG. 16) of the two primary-side sub-projections 93*a* is located outside the outer core 91 while the other (upper side in FIG. 16) engages with the center groove 77 of the outer core 91 at the center of the shorter side thereof, whereby the outer core 91 is sandwiched therebetween.

Similarly, primary-side sub-projections 93*b* are provided on both sides of the primary-side terminal block body 79*b* toward the primary-side terminal block flange 46*b* so as to project out of the plane FIG. 16. One (upper side in FIG. 16) of the two primary-side sub-projections 93*b* is located outside the outer core 91 while the other (lower side in FIG. 16) engages with the center groove 77 of the outer core 91 at the center of the shorter side thereof, whereby the outer core 91 is sandwiched therebetween.

Secondary-side sub-projections 94*a* are provided on both sides of the secondary-side terminal block body 83*a* toward the secondary-side terminal block flange 51*a* (near the secondary-side terminal block projections 84*a* and the secondary-side terminal block grooves 85*a*) so as to project out of the plane of FIG. 16. One (lower side in FIG. 16) of the two secondary-side sub-projections 94*a* is located outside the outer core 91 while the other (upper side in FIG. 16) engages with the center groove 77 of the outer core 91 at the center of the shorter side thereof, whereby the outer core 91 is sandwiched therebetween.

Similarly, secondary-side sub-projections 94*b* are provided on both sides of the secondary-side terminal block body 83*b* toward the secondary-side terminal block flange 51*b*. One (upper side in FIG. 16) of the two secondary-side sub-projections 94*b* is located outside the outer core 91 while the other (lower side in FIG. 16) engages with the center groove 77 of the outer core 91 at the center of the shorter side, whereby the outer core 91 is sandwiched therebetween.

In the fourth embodiment, in the bobbins 92*a* and 92*b*, the primary-side terminal blocks 78*a* and 78*b* engage with one groove 30 (right side in FIG. 17), and the secondary-side terminal blocks 82*a* and 82*b* engage with the other groove 30 (left side in FIG. 17) similar to the first embodiment.

Furthermore, in the fourth embodiment, the primary-side sub-projections 93*a* and 93*b* and the secondary-side sub-projections 94*a* and 94*b* sandwich the outer core 91 in addition to that the primary-side terminal blocks 78*a* and 78*b* and the secondary-side terminal blocks 82*a* and 82*b* engage with the grooves 30, whereby the first and second bobbins 92*a* and 92*b* can be fixed to the outer core 91 more fly than in the first embodiment.

Figure 20:
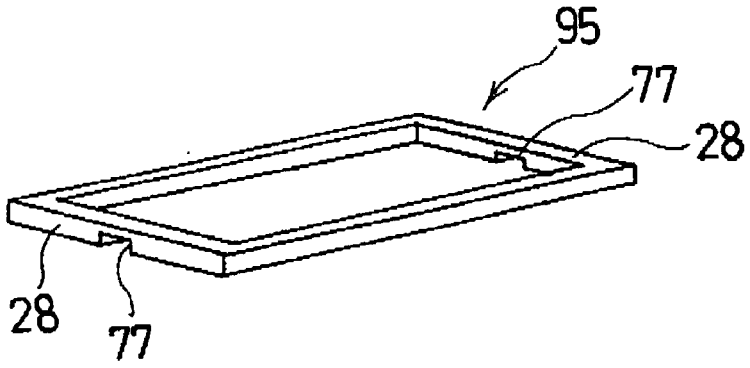
FIG. 20 is a perspective view showing still another outer core (fifth embodiment) in place of the outer core shown in FIG. 15.

In place of the outer core 91 (FIG. 17) of the fourth embodiment, an outer core 95 configured as shown in FIG. 20, for instance, may be used (fifth embodiment). The outer core 95 eliminates the grooves 30 and the notches (FIG. 17) of the outer core 91 so as to be smaller in thickness, thereby simplifying the configuration.

In the fifth embodiment, the first and second bobbins 74*a* and 74*b* (FIG. 10) are fixed to the outer core 95 by means of adhesive and also fixed thereto in such a manner that the primary-side sub-projections 93*a* and 93*b* and the secondary-side sub-projections 94*a* and 94*b* sandwich the outer core 95, thereby realizing firmer fixation.

In addition, the outer core 95 eliminates the grooves 30 and notches 75, whereby the configuration is simplified for easier production improving productivity.

Figure 21:
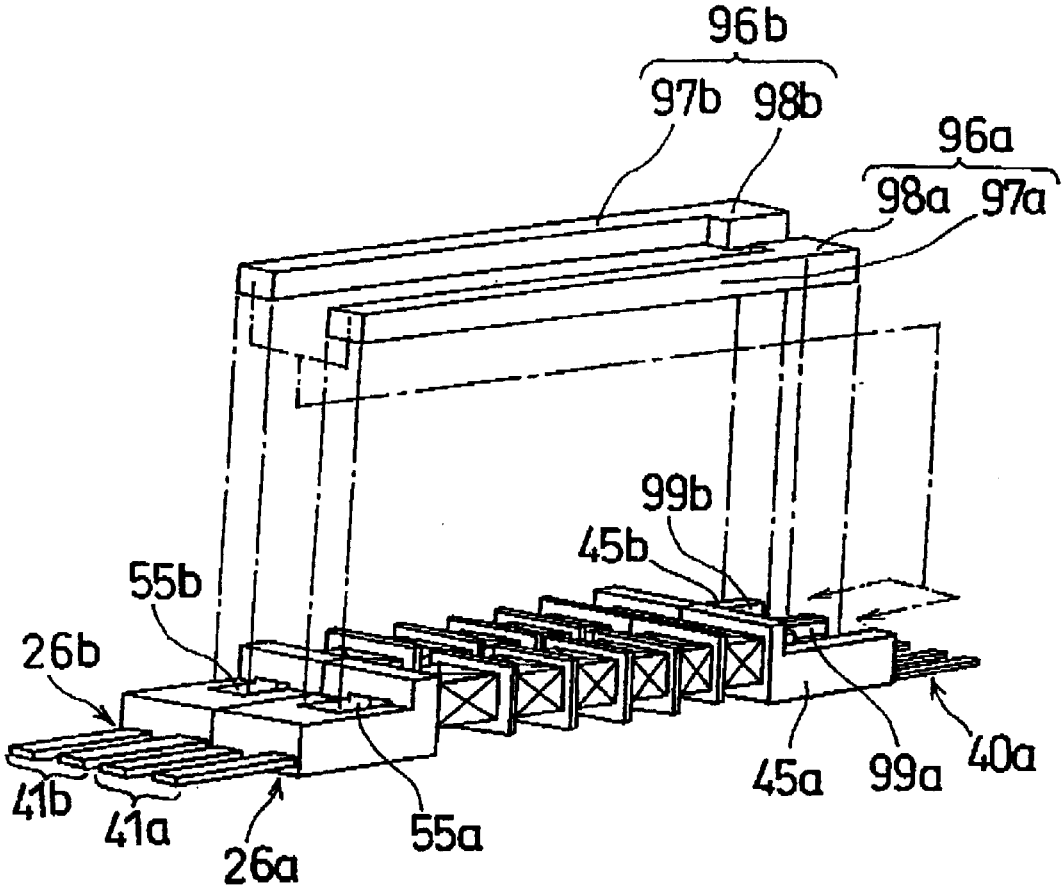
FIG. 21 is an exploded perspective view schematically showing an inverter transformer according to a sixth embodiment of the present invention.
Figure 22:
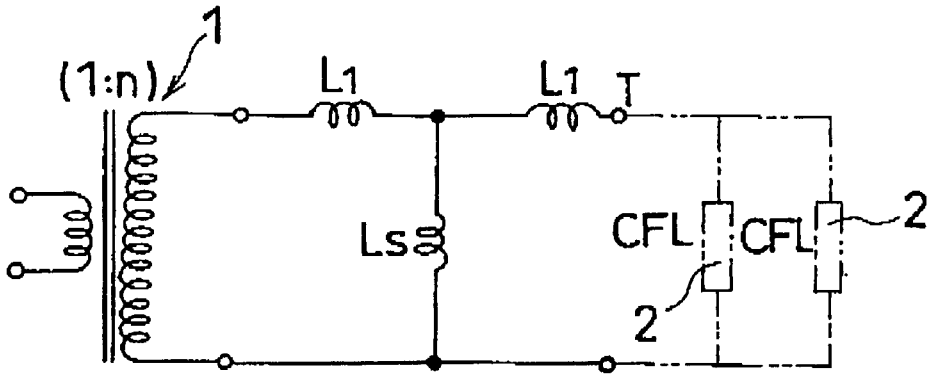
FIG. 22 PRIOR ART
FIG. 22 is a diagram showing an equivalent circuit of a conventional open-magnetic-circuit inverter transformer.
Figure 23:
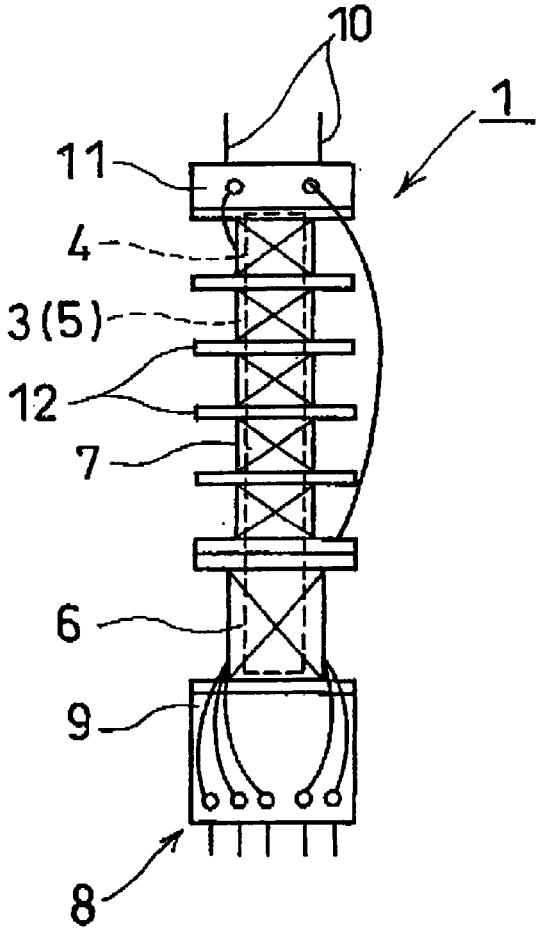
FIG. 23 PRIOR ART
FIG. 23 is a plan view schematically showing a conventional open-magnetic-circuit inverter transformer using an inner core.
Figure 24:
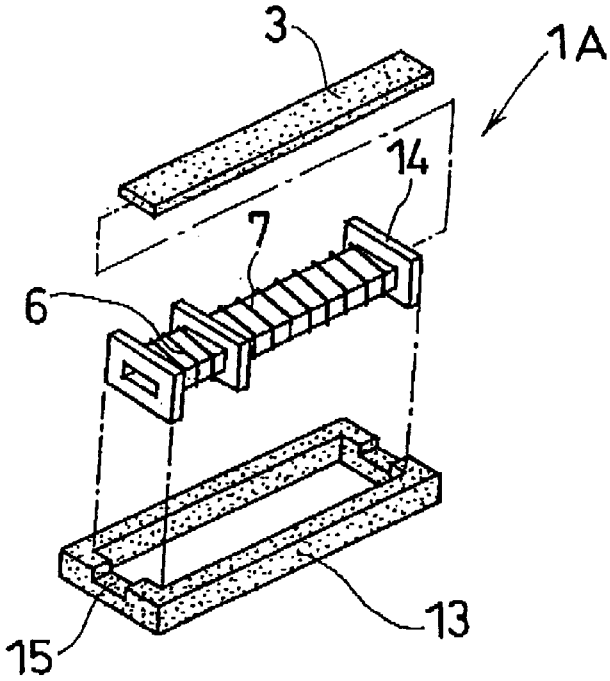
FIG. 24 PRIOR ART
FIG. 24 is an exploded perspective view showing a conventional closed-magnetic-circuit inverter transformer.
Figure 25:
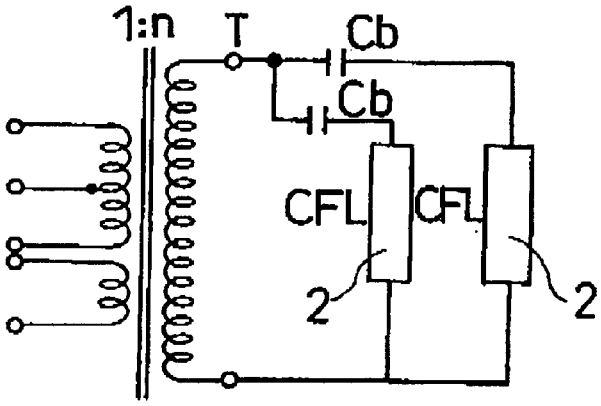
FIG. 25 PRIOR ART
FIG. 25 is a diagram showing a circuit using ballast capacitors in the closed-magnetic-circuit inverter transformer.

Next, an inverter transformer according to a sixth embodiment of the present invention will be explained with reference to FIG. 21. The parts and members equivalent to those of FIGS. 1 to 20 and FIGS. 22 to 25 are given the same reference numerals, and an explanation thereof is thus omitted. In FIG. 21, for convenience sake, the primary-side projections 48*a* and 48*b*, the primary-side grooves 49*a* and 49*b*, the secondary-side projections 52*a* and 52*b*, and the secondary-side grooves 53*a* and 63*b* are omitted from the description.

In the sixth embodiment, inner cores 96*a* and 96*b* are provided in place of the inner cores 23*a* and 23*b* of the first embodiment. The inner core 96*a* is shaped substantially like an L and composed of a longer bar 97*a* and a shorter bar 98*a* extending orthogonal to the longer bar 97*a*.

A hollow 55*a* of the first bobbin 26*a* has an opening 99*a* it a top face (upper side in FIG. 21) of a primary-side terminal block body 45*a*. The opening 99*a*, unlike the one in the first embodiment that has a constant width, has a larger width at the distal end to form an approximate L-shape. The end portion of the inner core 96*a* including the shorter bar 98*a* is adapted to engage with the opening 99*a*.

The inner core 96*b* is configured similar to the inner core 96*a* and composed of a longer bar 97*a* and a shorter bar 98*b*, and the end portion thereof including the shorter bar 98*b* is adapted to engage with an opening 99*b* formed in the second bobbin 26*b*.

In the sixth embodiment of the present invention, the inner cores 96*a* and 96*b* include the shorter bars 98*a* and 98*b* so as to be magnetically coupled with the outer core 21 (FIG. 1) more closely at the primary side, and so as to control the amount of gap from the outer core 21 only at the secondary side for a desired leakage inductance value, thus resulting in simplified control of the leakage inductance.

According to the present invention, since an inverter transformer, while having a primary winding in common, has a plurality of secondary windings independent of one another, a plurality of CFLs can be turned on simultaneously without providing a plurality of inverter transformers or ballast capacitors which are required conventionally, resulting in simplification of device and cost reduction.

Furthermore, the plurality of CFLs can be turned on with one outer core common to a plurality of inner cores (secondary windings), whereby the number of components can be reduced compared with when a plurality of outer cores are provided corresponding to the plurality of inner cores, resulting in downsizing and cost reduction.

In the above invention, a plurality of bobbins may be combined for integration by engaging projections with grooves, resulting in more reliable fixation and improved workability.

In the above invention, the outer core and the plurality of bobbins may be integrated by engaging parts of the primary-side and secondary-side terminal blocks of the plurality of bobbins with the grooves formed at the core, resulting in more reliably fixation and improved workability.

In the above invention, the projections disposed on the primary-side and secondary-side terminal blocks of the plurality of bobbins may engage with the grooves formed on the outer core or with the outside portion of the outer core, resulting in firmer and more reliable fixation to the outer core.

In the above invention, the plurality of inner cores may be shaped substantially like an L and have a larger width at the primary side, whereby the plurality of inner cores and the outer core shaped substantially like a rectangular frame can be magnetically coupled more closely at the primary side than the secondary side, and the amount of gap therebetween can be controlled only at the secondary side for a desired leakage inductance value, resulting in a simplified leakage inductance control.

In the above invention, the plurality of bobbins may be shaped identical to one another, whereby the plurality of bobbins can be produced by using a same die, resulting in reduced manufacturing costs.

While the present invention has been illustrated and explained with respect to specific embodiments thereof, it is to be understood that the present invention is by no means limited thereto but encompasses all changes and modifications which will become possible within the scope of the appended claims.

What is claimed is:

1. An inverter transformer provided in a DC to AC inverter circuit and adapted to step up an AC voltage inputted to a primary side thereof and to output to a secondary side, comprising:

an outer core shaped substantially like a rectangular frame;

a plurality of inner cores shaped substantially like a bar, disposed inside the outer core and connected thereto so as to provide a predetermined leakage inductance;

a plurality of secondary windings provided corresponding to the plurality of inner cores;

a primary winding common to the plurality of secondary windings; and a plurality of bobbins shaped substantially like a tube, provided corresponding to the plurality of secondary windings, each of the bobbins including a primary-side terminal block for the primary winding at one end thereof and a secondary-side terminal block for each of the secondary windings at the other end thereof, having each of the inner cores inserted therein, and having each of the secondary windings wound thereon, and the plurality of bobbins, with respective secondary windings wound thereon, being connected together for integration, and having the primary winding wound thereon.

2. An inverter transformer according to claim 1, wherein the plurality of bobbins are integrated such that respective primary-side terminal blocks each having a projection and a groove at a connecting portion are connected to one another and respective secondary-side terminal blocks each having a projection and a groove at a connecting portion are connected to one another.

3. An inverter transformer according to claim 1, wherein the outer core is provided with grooves for engaging with part of the primary-side and secondary-side terminal blocks of the plurality of bobbins integrated.

4. An inverter transformer according to claim 1, wherein the primary-side and secondary-side terminal blocks of the plurality of bobbins are provided with projections for engaging either with grooves formed on the outer core or with outside portions of the outer core.

5. An inverter transformer according to claim 1, wherein the pluarlity of inner cores are shaped substantially like an L.

6. An inverter transformer according to claim 1, wherein the plurality of bobbins are shaped identical with one another.

7. An inverter transformer according to claim 2, wherein the outer core is provided with grooves for engaging with part of the primary-side and secondary-side terminal blocks of the plurality of bobbins integrated.

8. An inverter transformer according to claim 2, wherein the primary-side and secondary-side terminal blocks of the plurality of bobbins are provided with projections for engaging either with grooves formed on the outer core or with outside portions of the outer core.

9. An inverter transformer according to claim 3, wherein the primary-side and secondary-side terminal blocks of the plurality of bobbins are provided with projections for engaging either with grooves formed on the outer core or with outside portions of the outer core.

10. An inverter transformer according to claim 2, wherein the plurality of inner cores are shaped substantially like an L.

11. An inverter transformer according to claim 3, wherein the plurality of inner cores are shaped substantially like an L.

12. An inverter transformer according to claim 4, wherein the plurality of inner cores are shaped substantially like an L.

13. An inverter transformer according to claim 2, wherein the plurality of bobbins are shaped identical with one another.

14. An inverter transformer according to claim 3, wherein the plurality of bobbins are shaped identical with one another.

15. An inverter transformer according to claim 4, wherein the plurality of bobbins are shaped identical with one another.

16. An inverter transformer according to claim 5, wherein the plurality of bobbins are shaped identical with one another.

* * * * *